US007923929B2

(12) United States Patent
Ohmura et al.

(10) Patent No.: US 7,923,929 B2
(45) Date of Patent: Apr. 12, 2011

(54) PHOTOMULTIPLIER INCLUDING A PHOTOCATHODE AND AN ACCELERATING ELECTRODE

(75) Inventors: Takayuki Ohmura, Hamamatsu (JP); Suenori Kimura, Hamamatsu (JP); Masuo Ito, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 249 days.

(21) Appl. No.: 12/149,712

(22) Filed: May 7, 2008

(65) Prior Publication Data

US 2008/0211403 A1 Sep. 4, 2008

Related U.S. Application Data

(63) Continuation of application No. 11/294,535, filed on Dec. 6, 2005, now Pat. No. 7,427,835.

(60) Provisional application No. 60/666,564, filed on Mar. 31, 2005.

(51) Int. Cl.
*H01J 43/18* (2006.01)
*H01J 40/14* (2006.01)

(52) U.S. Cl. ..... 313/533; 250/207

(58) Field of Classification Search ..... None
See application file for complete search history.

(56) References Cited

U.S. PATENT DOCUMENTS

| | | | |
|---|---|---|---|
| 2,818,520 | A | 12/1957 | Engstrom et al. |
| 3,099,764 | A | 7/1963 | McDonie et al. |
| 3,109,957 | A | 11/1963 | McGee et al. |
| RE30,249 | E | 4/1980 | Faulkner |
| 4,431,943 | A | 2/1984 | Faulkner et al. |
| 4,990,827 | A | 2/1991 | Ehrfeld et al. |
| 5,363,014 | A | 11/1994 | Nakamura |
| 5,598,061 | A | 1/1997 | Nakamura et al. |

FOREIGN PATENT DOCUMENTS

| | | |
|---|---|---|
| EP | 0 539 229 | 4/1993 |
| JP | A-5-114384 | 5/1993 |
| JP | A-8-050877 | 2/1996 |

*Primary Examiner* — Toan Ton
*Assistant Examiner* — Britt D Hanley
(74) *Attorney, Agent, or Firm* — Drinker Biddle & Reath LLP

(57) ABSTRACT

The present invention relates to a photomultiplier having a structure that enables to perform high gain and satisfy higher required characteristics. In the photomultiplier, an electron-multiplying unit accommodated in a sealed container comprises a focusing electrode, an accelerating electrode, a dynode unit, and an anode. Particularly, at least the accelerating electrode and dynode unit are held unitedly in a state that at least a first-stage dynode and a second-stage included in the dynode unit are opposite directly to the accelerating electrode not through a conductive material. A conventional metal disk for supporting directly dynodes which are set to the same potential as that of the first-stage dynode is not placed between the accelerating electrode and dynode unit; thus, variations of the transit time of electrons may be drastically reduced while the electrons reach from the cathode to the second-stage dynode via the first-stage dynode.

1 Claim, 15 Drawing Sheets

250a
210
200
250b
310
300
320
410a
DY1
DY1a
DY2a
DY2
DY2b
DY3
DY1b
DY3a
DY3b
450c
DY4a
DY4
DY4b
DY5
DY5a
DY5b
410b
400
DY6a
DY6
DY6b
DY7a
DY7
DY7b
DY8a
DY8
DY8b
420b
420d
420
450b
450a

PHOTOMULTIPLIER INCLUDING A PHOTOCATHODE AND AN ACCELERATING ELECTRODE

CROSS-REFERENCE TO RELATED APPLICATION

This is a continuation application of application Ser. No. 11/294,535, filed on Dec. 6, 2005 now U.S. Pat. No. 7,427,835 which is incorporated by reference herein in its entirety. This continuation application, like its parent application Ser. No. 11/294,535, claims priority to Provisional Application No. 60/666,564 filed on Mar. 31, 2005 by the same Applicant which is also hereby incorporated by reference in its entirety.

BACKGROUND OF THE INVENTION

1. Field of the Invention

The present invention relates to a photomultiplier that enables a cascade-multiplication of secondary electrons by emitting sequentially the secondary electrons through a plurality of stages in response to incidence of photoelectrons.

2. Related Background Art

In recent years, developments of TOF-PET (Time-of-Flight-PET) are earnestly proceeding as a PET (Positron-Emission Tomography) apparatus for the next generation in the field of nuclear medicine. In particular, in the TOF-PET apparatus, when two gamma rays emitted from a radioactive isotope administered in a body are simultaneously measured at two detectors in directions opposite to each other, a time difference in signals outputted from the two detectors can be determined, which enables to determine a disappeared position of positrons as a difference in flight or transit time; thus, it becomes possible to obtain a vivid image of the PET. A photomultiplier with a large capacity having an excellent high-speed response is employed for the detectors.

For example, a photomultiplier shown in JP-A-5-114384 is known as the aforementioned one. In the conventional photomultiplier has a construction such that a focusing electrode and an accelerating electrode are arranged in this turn from a cathode toward a first-stage dynode. In this case, the focusing electrode is the one correcting an orbit of each photoelectron emitted from the cathode such that the photoelectrons may be focused on the first-stage dynode. In addition, the accelerating electrode is the one accelerating the photoelectrons emitted from the cathode to the first-stage dynode, and has a function to reduce variations in transit time from the cathode to the first-stage dynode caused by the emission area of the photoelectrons of the cathode.

A high-speed response can be achieved by the configuration arranging the focusing electrode and accelerating electrode between the cathode and the first-stage dynode, as mentioned above.

SUMMARY OF THE INVENTION

The inventors have studied the foregoing prior art in detail, and as a result, have found problems as follows.

Namely, in the conventional photomultiplier, an electron-multiplying unit housed in a sealed container and performing an excellent high-speed response is constructed by a dynode unit such that a plurality of stages of dynodes together with an anode are sandwiched between a pair of insulating fixing plates, a focusing electrode, and an accelerating electrode. In the assembly work, the accelerating electrode is fixed to the dynode unit by a specific metal member, while the focusing electrode is fixed to the accelerating electrode through a glass member. The conventional photomultiplier obtained through the above assembly process has a structure such that a metal disk having the same potential as that of the first-stage dynode and supporting directly the first-stage dynode is disposed between the accelerating electrode and first-stage dynode. In this case, there is a problem such that the effect of the metal disk arranged between the accelerating electrode and first-stage electrode occurs remarkable variations in the transit time of electrons reaching the second-stage dynode from the cathode via the first-stage dynode depending upon the emission area of photoelectrons of the cathode, thus increasing CTTD (Cathode Transit Time Difference) and deteriorating TTS (Transit Time Spread).

The present invention is made to solve the aforementioned problem, and it is an object to provide a photomultiplier having a structure capable of performing a high gain and satisfying higher required characteristics with respect to Uniformity, CTTD, TTS, and so on.

A photomultiplier according to the present invention comprises a sealed container of which the inside is kept in a vacuum state, and a cathode, a focusing electrode, an accelerating electrode, a dynode unit, and an anode each to be placed in the sealed container. In addition, the dynode unit and anode are unitedly held in a state sandwiched by a pair of insulating support members. The cathode emits photoelectrons as a primary electron within the sealed container in response to incidence of light having a predetermined wavelength. The dynode unit includes a plurality of stages of dynodes emitting secondary electrons in response to the photoelectrons reached from the photocathode to cascade-multiply sequentially the photoelectrons. The anode takes out the secondary electrons cascade-multiplied by the dynode unit as a signal. The focusing electrode functions to correct the orbit of each photoelectron emitted from the photocathode, and is arranged between the photocathode and dynode unit. Furthermore, the focusing electrode has a through hole through which the photoelectrons from the photocathode pass. The accelerating electrode functions to accelerate the photoelectrons reached from the photocathode via the focusing electrode, and is arranged between the focusing electrode and dynode unit. Also, the accelerating electrode has a through hole through which the photoelectrons reached from the photocathode via the focusing electrode pass.

Specifically, as characteristics required for the photomultiplier according to the present invention, there are uniformity, CTTD (Cathode Transit Time Difference), TTS (Transit Time Spread) and so on; the photomultiplier provides as an effective area the whole surface of the cathode for the uniformity, and performs the CTTD of 500 psec or less, and the TTS of 300 psec or less. Therefore, the photomultiplier according to the present invention has a structure for holding unitedly at least the accelerating electrode and dynode unit in a state that at least a first-stage dynode and a second-stage dynode included in the dynode unit is directly opposite to the accelerating electrode while they are not through a conductive member.

In this way, in accordance with the photomultiplier, at least the accelerating electrode and dynode unit has a structure for holding unitedly in a state that at least the first-stage dynode and second-stage dynode included in the dynode unit is directly opposite to the accelerating electrode while they are not through a conductive member. As a result, a metal disk that is set to the same potential as that of a first-stage dynode, and that supports directly the first-stage dynode is not placed between the accelerating electrode and dynode unit; thus, variations of the transit time of the electrons may be drastically reduced in a route reached from the cathode to the second-stage dynode via the first-stage dynode.

Further, as described above, in order to eliminate the metal disk (set to the same potential as that of the first-stage dynode) for supporting directly the first-stage dynode between the first-stage dynode included in the dynode unit and the accelerating electrode, it is preferable to be constructed simply (i.e., not complicating the assembly process) in such a manner that at least the accelerating electrode and dynode unit are unitedly held.

The aforementioned united construction can be performed in such a manner that, for example, one or more protruding portions serving as a reference of the arranged positions of the focusing electrode and accelerating electrode, extending toward the photocathode, are provided for each of a pair of insulating support members for holding unitedly the plurality of dynodes included in the dynode unit. Namely, for each of the protruding portions, a first fixture structure for fixing the accelerating electrode in a state of supporting directly the accelerating electrode is provided, and a second fixture structure for fixing the focusing electrode in a state of supporting directly the focusing electrode is provided. In this case, in the photomultiplier, when the protruding portion (attached with the first and second fixture structures) serving as a reference of the arranged positions of the accelerating electrode and focusing electrode is provided for each of the pair of insulating support members for holding the dynode unit and anode, the focusing electrode, accelerating electrode, dynode unit, and anode constructing the electron-multiplying unit accommodated in the sealed container may be fixed unitedly to the pair of insulating support members. In other words, owing to the structure fixing the focusing electrode and accelerating electrode, provided at part of the pair of insulating support members for grasping unitedly the dynode unit and anode, the members constructing the electron-multiplying unit each can be simply positioned by using the pair of insulating support members as a reference member. As a result, on assembly of the electron-multiplying unit, positioning work with high precision between the members, specific fixing members and fixing jigs becomes unnecessary, which enables to improve drastically the productivity of the electron-multiplying unit accommodated in the sealed container. In addition, variations in performance between produced photomultipliers can be reduced irrespective of skilled degree of workers themselves.

Besides, in the photomultiplier according to the present invention, the protruding portions, constructing a part of each of the pair of insulating support members, are arranged at predetermined positions of the pair of insulating support members in a state grasping the dynodes and anode to surround at least the accelerating electrode. In addition, in the photomultiplier, it is preferable that a first fixture structure includes a slit groove for pinching a part of the accelerating electrode. From a similar reason, it is preferable that a second fixture structure also includes a slit groove for pinching a part of the focusing electrode. Thus, when parts of the focusing electrode and accelerating electrode are pinched by the associated slit grooves, respectively, alignment work and fixing work of the focusing and accelerating electrodes can be carried out simultaneously.

Further, the photomultiplier according to the present invention is not limited to the aforementioned construction. Namely, even when the photomultiplier has a metal disk for supporting directly the first-dynode included in the dynode unit, it is possible to satisfy the aforementioned required characteristics when it is disposed in a state that the metal disk is insulated from both of the accelerating electrode and dynode unit. The metal disk arranged between the accelerating electrode and dynode unit is set to a potential higher that that of the first-stage dynode included in the dynode unit.

Furthermore, even when a metal disk is arranged, which supports directly the first-stage dynode included in the dynode unit between the accelerating electrode and dynode unit, and which is set to the same potential as that of the first-stage dynode, according to the photomultiplier, it is possible to satisfy the aforementioned required characteristics. Namely, the aforementioned required characteristics can be satisfied by the following manner: the metal disk arranged between the accelerating electrode and dynode unit has a through hole to be passed through by the photoelectrons form the cathode; further, the shortest distance from the tube axis to the edge of the through hole is set to 1.3 or more times the shortest distance from the tube axis of the sealed container to the end portion of the second-stage dynode included in the dynode unit. However, it is more preferable that the shortest distance from the tube axis to the edge of the through hole is set to 2.0 or more times the shortest distance from the tube axis of the sealed container to the end portion of the second-stage dynode included in the dynode unit.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DETAILED DESCRIPTION OF THE PREFERRED EMBODIMENTS

In the following, embodiments of a photomultiplier according to the present invention will be explained in detail with reference to FIGS. 1-12, 13A-14B and 15. In the explanation of the drawings, constituents identical to each other will be referred to with numerals identical to each other without repeating their overlapping descriptions.

Figure 1:
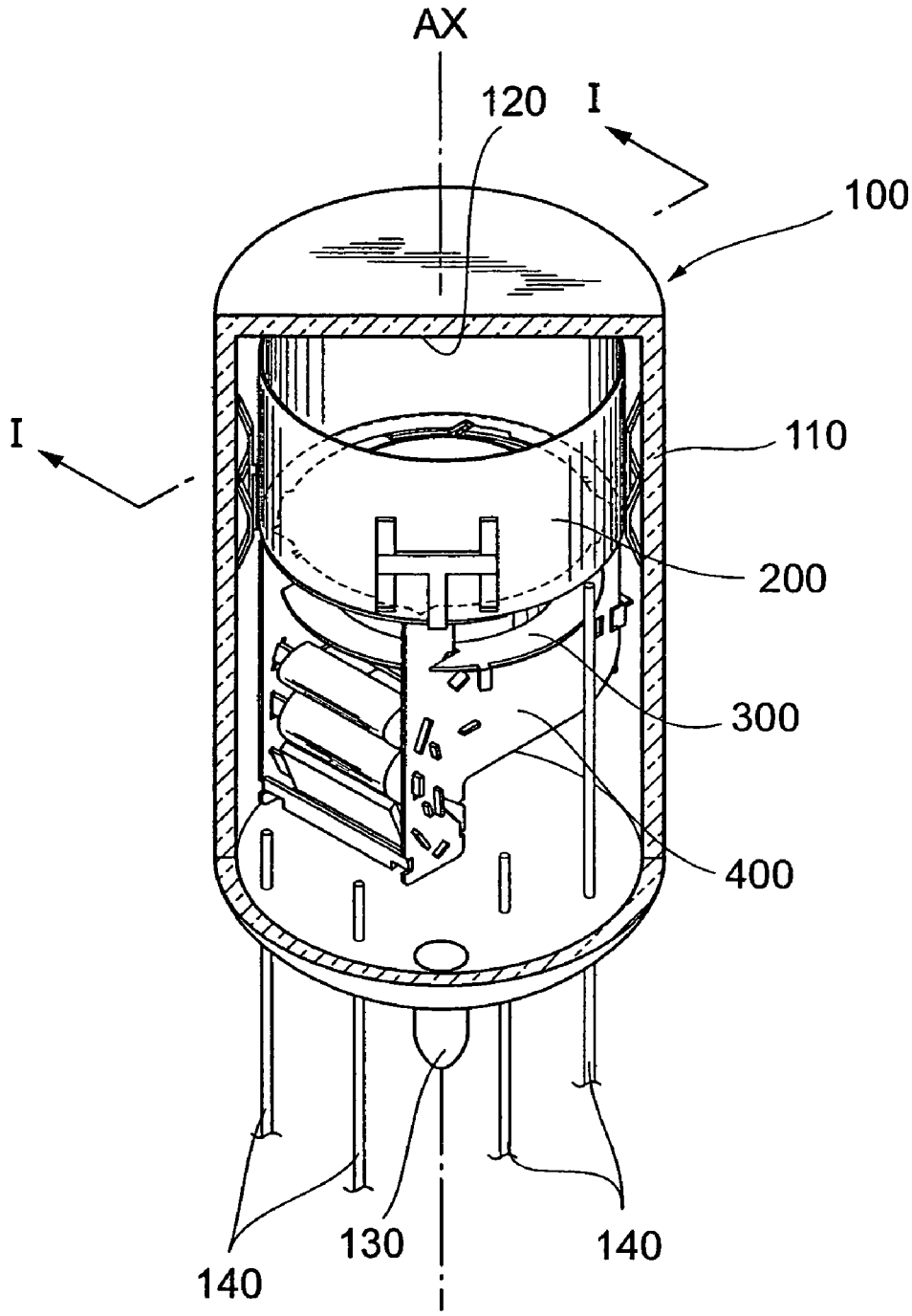
FIG. 1 is a partially cutaway view illustrating a schematic structure of a first embodiment of the photomultiplier according to the present invention.

FIG. 1 is a partially cutaway view illustrating a schematic structure of a photomultiplier of an embodiment according to the present invention.

As shown in FIG. 1, a photomultiplier 100 includes a sealed container 110 provided with a pipe 130 (solidified after evacuation) for evacuating the inside at the bottom thereof, a cathode 120 provided in the sealed container 110 and an electron-multiplying unit.

The sealed container 110 is constituted by a cylindrical body having a face plate, the inside of which is formed with a cathode 120, and a stem supporting a plurality of lead pins 140 in their penetrating state. The electron-multiplying unit is held at a predetermined position within the sealed container 110 by the lead pins 140 extending from the stem to the inside of the sealed container 110.

The electron-multiplying unit is constituted by a focusing electrode 200, an accelerating electrode 300, and a dynode unit 400 disposing an anode thereinside. The focusing electrode 200 is an electrode correcting an orbit of each photoelectron emitted from the cathode 120 such that the photoelectrons may be focused to the dynode unit 400, and has a through hole which is arranged between the cathode 120 and dynode unit 400 and through which the photoelectrons from the cathode 120 pass. In addition, the accelerating electrode 300 is an electrode accelerating the photoelectrons emitted from the cathode 120 to the dynode unit 400, and has a through hole that is arranged between the focusing electrode 200 and dynode unit 400 such that the photoelectrons passed through the through hole of the focusing electrode can be further accelerated toward the dynode unit 400. Due to the accelerating electrode 300, a variation in transit time of the photoelectrons reached from the cathode 120 to the dynode unit 400 can be reduced, though it is caused by the photoelectrons emitting area of the cathode 120. Furthermore, the dynode unit 400 includes a plurality of stages of dynodes cascade-multiplying sequentially secondary electrons emitted in response to the photoelectrons reached from the cathode 120 through the focusing electrode 200 and accelerating electrode 300, an anode taking out the secondary electrons cascade-multiplied by means of these plurality of stages of dynodes, and a pair of insulating support members grasping unitedly these plurality of stages of dynodes and the anode.

Figure 2:
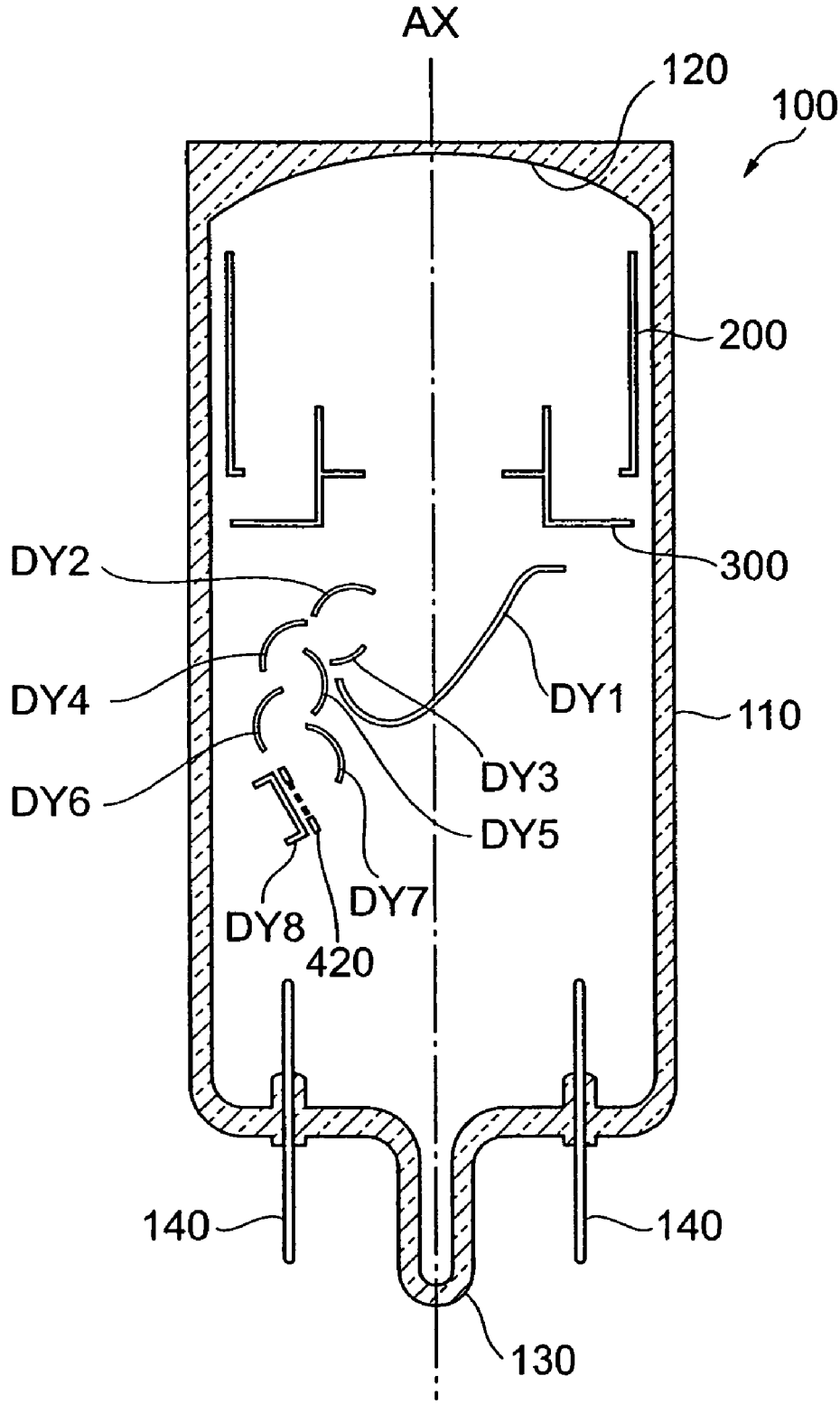
FIG. 2 is a view illustrating a cross-sectional structure of the photomultiplier according to the first embodiment, taken along the line I-I depicted in FIG. 1.

FIG. 2 is a view illustrating a cross-sectional structure of the photomultiplier according to a first embodiment, taken along the line I-I depicted in FIG. 1.

In the photomultiplier 100 according to the first embodiment, the electron-multiplying unit 400 housed in the sealed container 110, as shown in FIG. 2, is unitedly held by a pair of insulating support members together with the focusing electrode 200 and accelerating electrode 300. In particular, associated with the accelerating electrode 300, the pair of insulating support members hold unitedly a first dynode (first-stage dynode) DY1 to a seventh dynode DY7, an anode 420, and a reflection-type of dynode DY8 for reversing the electrons passed through the anode 420 toward the anode 420 again.

Thus, in a state that at least the first dynode DY1 and second dynode DY2 contained in the dynode unit 400 is directly opposite to the accelerating electrode 300 without going through the conductive member, the photomultiplier 100 has a structure holding unitedly at least the accelerating electrode 300 and dynode unit 400. As a result, since a metal disk supporting directly the first dynode DY1 that is set to the same potential as that of the first dynode DY1 like the conventional photomultiplier is not placed between the accelerating electrode 300 and dynode unit 400, variations in transit time of electrons can be reduced drastically while the electrons reach from the cathode 120 to the second dynode DY2 via the second dynode DY1.

In accordance with the aforementioned construction, the photomultiplier 100 brings the whole surface of the cathode to an effective region for uniformity, and performs CTTD of 500 psec or less and TTS of 300 psec or less.

Hereinafter, a specific example constituting unitedly the accelerating electrode 300 and dynode unit 400, as mentioned above, will be explained in detail with reference to FIGS. 3-12. The construction explained below can be achieved as follows: There are provided a pair of insulating support members holding unitedly a plurality of dynodes DY1 to DY8 contained in the dynode unit 400; one or more protruding portions extending toward the photocathode 120 and serving as a reference of the disposed positions of the focusing electrode 200 and accelerating electrode 300 are provided for each insulating support member.

Figure 3:
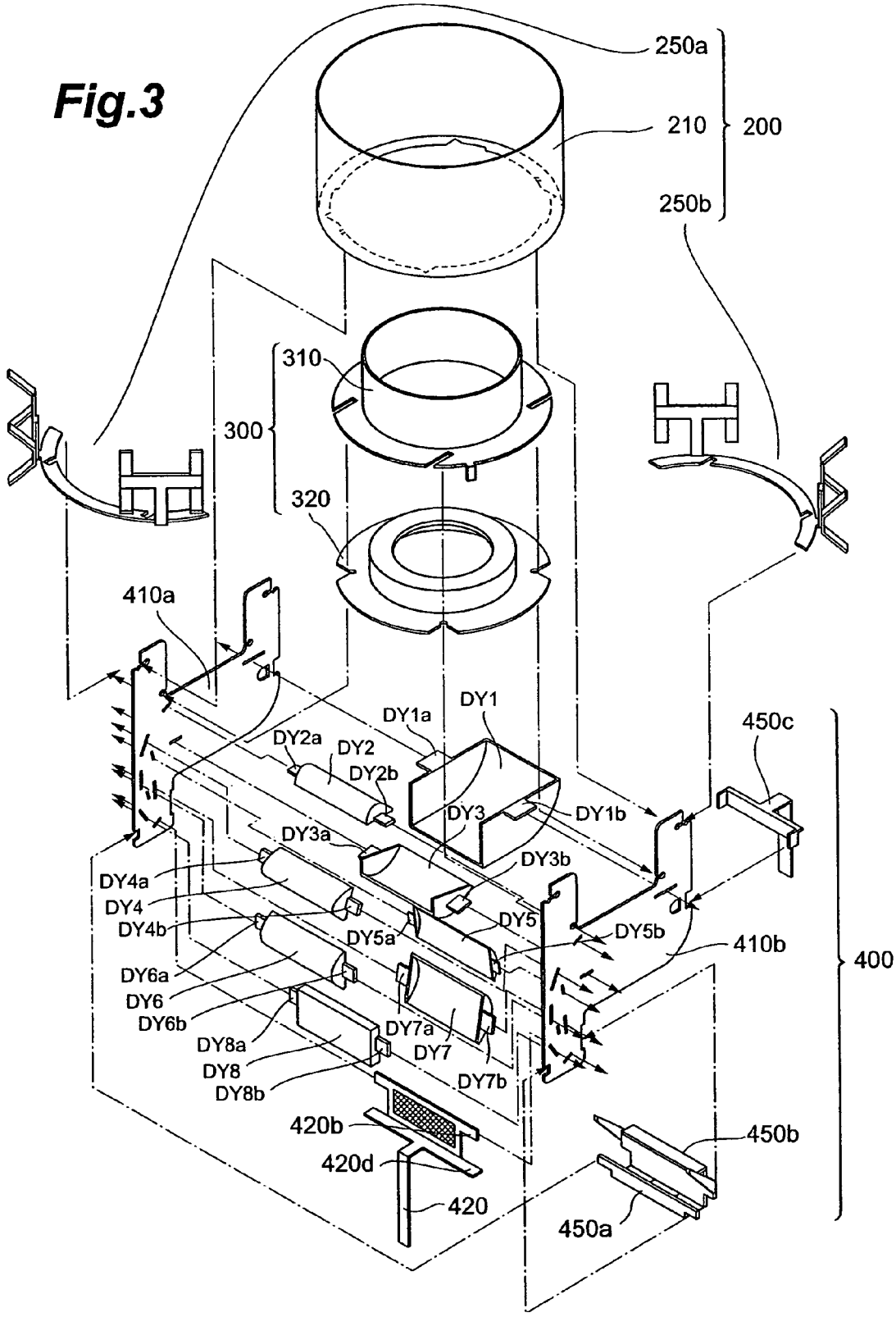
FIG. 3 is an assembly process view for explaining the construction of an electron-multiplying unit adapted to the photomultiplier according to the first embodiment.

FIG. 3 is an assembly process view for explaining the construction of the electron-multiplying unit applied to the photomultiplier according to the present invention.

As shown in FIG. 3, the electron-multiplying unit is constituted by the focusing electrode 200, accelerating electrode 300, and dynode unit 400 including the anode. The focusing electrode 200 is provided with a through hole through which the photoelectrons from the cathode 120 pass. The accelerating electrode 300 is constituted by an upper electrode 310 and a lower electrode 320 to improve an assembling efficiency of the electron-multiplying unit. These upper electrode 310 and lower electrode 320 are integrated by welding at several spots during the assembly work of the electron-multiplying unit. The dynode unit 400 is constituted by first to seventh dynodes DY1-DY7 each grasped by the first and second insulating support members 410*a*, 410*b*, an anode 420, and a reflection-type dynode DY8 reversing the electrons passed through the anode 420 toward the anode 420 again. In addition, in each of the first to seventh dynodes DY1-DY7 and the reflection-type dynode DY8, a reflection-type emission surface of secondary electrons is formed by receiving photoelectrons or secondary electrons to emit newly secondary electrons toward the incident direction of the electrons. In addition, fixed pieces DY1*a*, DY1*b* are provided to be grasped by the first and second insulating support members 410*a*, 410*b* at the two ends of the first dynode DY1. Similarly, the second dynode DY2 has fixed pieces DY2*a*, DY2*b* at its two ends; the third dynode DY3 has fixed pieces DY3*a*, DY3*b* at its two ends; the fourth dynode DY4 has fixed pieces DY4*a*, DY4*b* at its two ends; the fifth dynode DY5 has fixed pieces DY5*a*, DY5*b* at its two ends; the sixth dynode DY6 has fixed pieces DY6*a*, DY6*b* at its two ends; the seventh dynode DY7 has fixed pieces DY7*a*, DY7*b* at its two ends; the anode 420 has fixed pieces 420*a*-420*d* at its two ends; and the eighth dynode DY8 has fixed pieces DY8*a*, DY8*b* at its two ends.

The lower electrode 320 of the accelerating electrode 300 is grasped by the first and second insulating support members 410*a*, 410*b* together with the first to seventh dynodes DY1-DY7, anode 420, and reflection-type dynode DY8. Thus, the upper electrode 310 is fixed by welding at the lower electrode 320 in a grasped state by the first and second insulating support members 410*a*, 410*b*. On the other hand, the focusing electrode 200 is mounted at the protruding portions provided at the upper portions (cathode 120 side) of the first and second insulating support members 410*a*, 410*b*, and fixed at the first and second insulating support members 410*a*, 410*b* by welding of reinforcing members 250*a*, 250*b*.

In addition, as described above, in a state that the first to seventh dynodes DY1-DY7, anode 420, and reflection-type dynode DY8 are unitedly grasped, the first and second insulating support member 410*a*, 410*b* are further grasped by metal clips 450*a*-450*c*; thus, the aforementioned members are stably held by the first and second insulating support members 410*a*, 410*b*.

Figure 4:
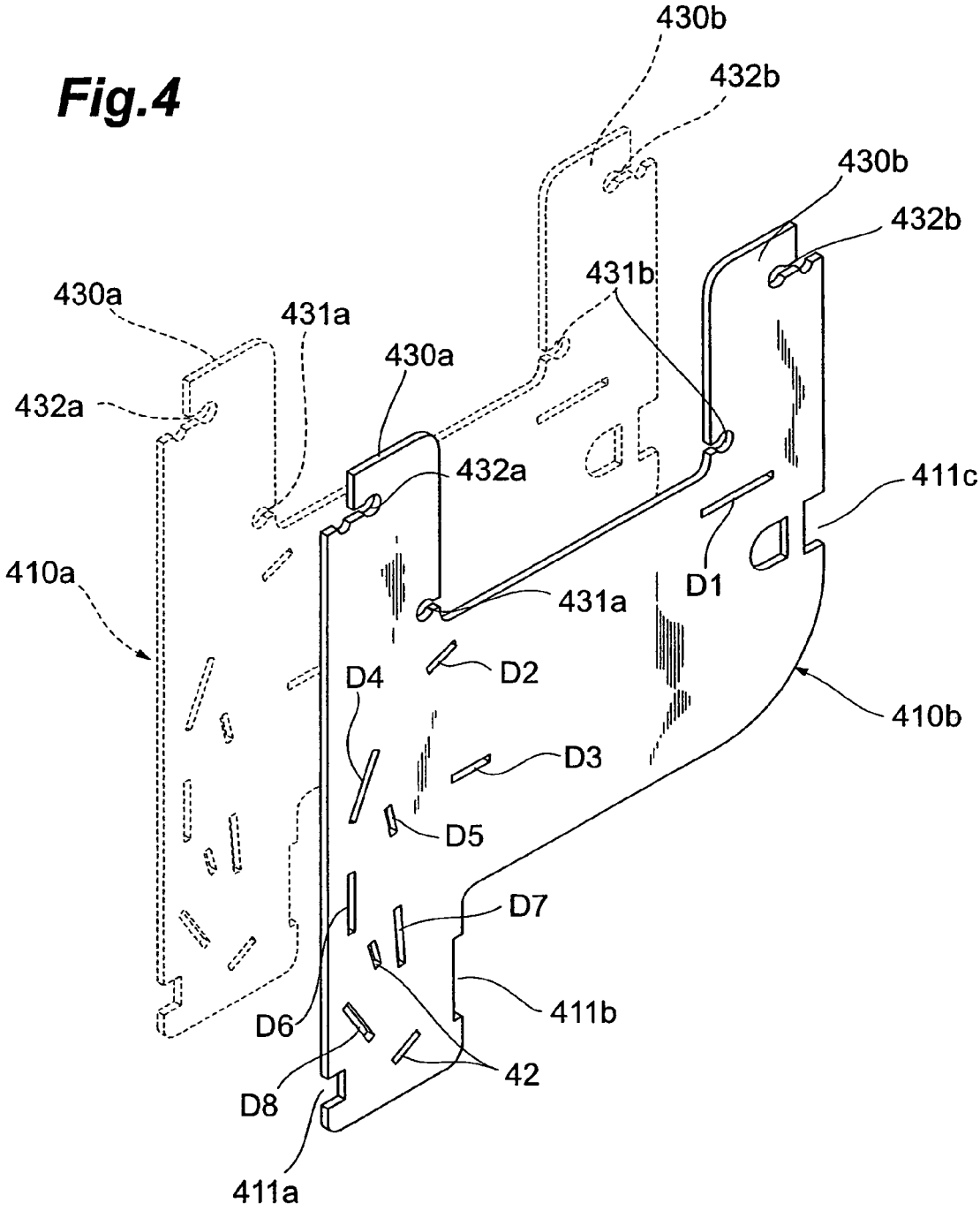
FIG. 4 is a view for explaining the structure of a pair of insulating support members constructing a part of the electron-multiplying unit.

FIG. 4 is a view for explaining the structure of the first and second insulating support members 410*a*, 410*b* constituting a part of the electron-multiplying unit. In this case, since the first and second insulating support members 410*a*, 410*b* have the same structure, only the second insulating support member 410*b* will now be explained for their common structure description below.

The insulating support member 410*b* is provided with alignment holes D1-D8 and 42 to be inserted by fixed pieces DY1*b*-DY8*b*, 420*b* of the first to seventh dynodes DY1-DY7, anode 420, and reflection-type dynode DY8. Also, the insulating support member 410*b* is provided with notched portions 411*a*-411*c* hooking the metal clips 450*a*-450*c* in order to easily secure to the insulating support member 410*a* grasping the members DY1-DY8, 420 together.

In particular, protruding portions 430*a*, 430*b* extending upwardly are provided at the insulating support member 410*b*. Namely, the protruding portions 430*a*, 430*b* extend toward the cathode side when the electron-multiplying unit is mounted in the sealed container 110. Then, at the protruding portion 430*a*, a slit groove 431*a* for aligning and fixing the accelerating electrode 300 as a first fixture structure, and a slit groove 432*a* for aligning and fixing the focusing electrode 200 as a second fixture structure are provided. Similarly, at the protruding portion 430*b*, a slit groove 431*b* for aligning and fixing the accelerating electrode 300 as a first fixture structure, and a slit groove 432*b* for aligning and fixing the focusing electrode 200 as a second fixture structure are provided.

Figure 5:
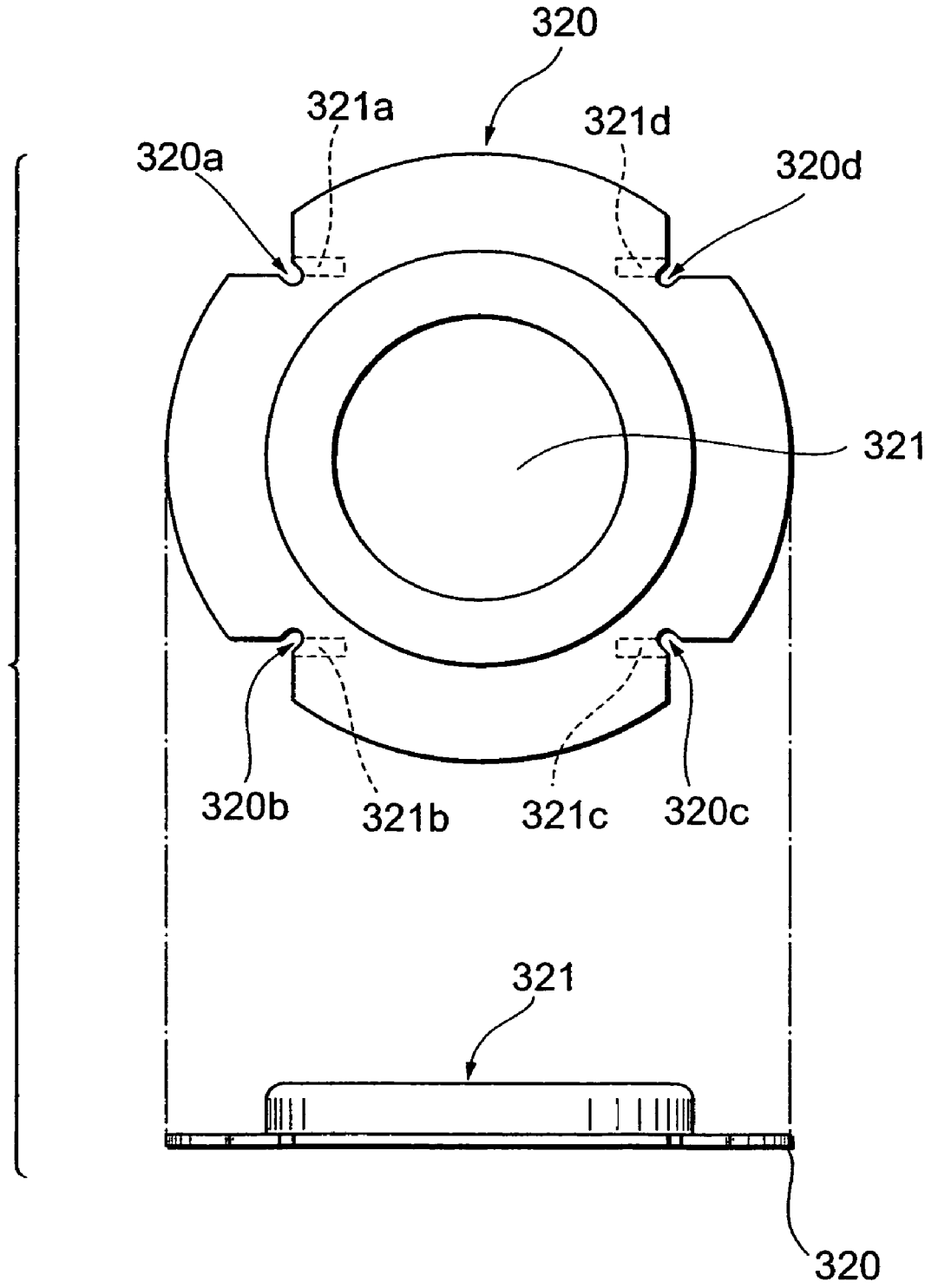
FIG. 5 is a plan view and a side view for explaining the structure of a lower electrode in an accelerating electrode.

Next, the structure of the accelerating electrode 300 will be explained with reference to FIG. 5 and FIG. 6. FIG. 5 is a plan view and a side view for explaining the structure of the lower electrode 320 constituting a part of the accelerating electrode 300. Also, FIG. 6 is a plan view and a side view for explaining the structure of the upper electrode 310 constituting a part of the accelerating electrode 300.

Figure 6:
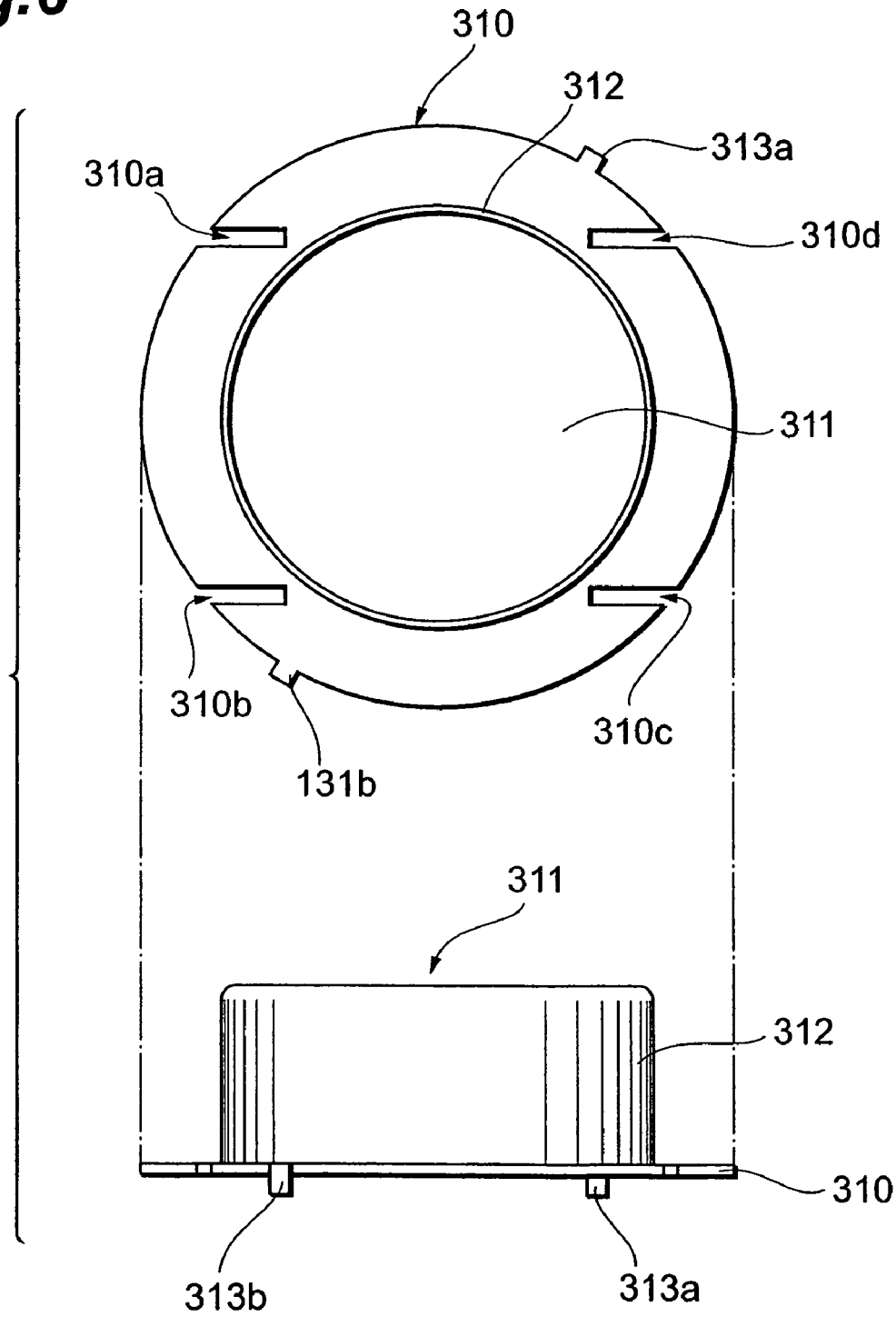
FIG. 6 is a plan view and a side view for explaining the structure of an upper electrode in the accelerating electrode.

The accelerating electrode 300 can be obtained by welding at several spots of the lower electrode 320 and upper electrode 310 having the structures as shown in FIGS. 5 and 6. The lower electrode 320 is directly inserted and fixed in the slit grooves 431*a*, 431*b*, which are provided at the respective protruding portions 430*a*, 430*b* of the first and second insulating support members 410*a*, 410*b*.

Specifically, as shown in FIG. 5, the lower electrode 320 is provided with notched portions 320*a*-320*d* to be grasped to the first and second insulating support members 410*a*, 410*b* together with the first to seventh dynodes DY1-DY7, anode 420, and reflection-type dynode DY8. In addition, at the flange portion located at the outer periphery of a through hole 321 provided at the accelerating electrode 320, the notched portions 320*a*-320*d* are arranged to surround the through hole 321. On the other hand, as shown in FIG. 6, the upper electrode 310 is constituted by a body unit 312 defining a through hole 311 and a flange portion at one open end of the body unit 311. At the outer periphery of the flange portion, slit grooves 310*a*-310*d* to sandwich the protruding portions 430*a*, 430*b* provided on each of the first and second insulating support members 410*a*, 410*b* are formed, and fixing section 313*a*, 313*b* to be fixed by welding to the lower electrode 320 are provided.

Figure 7:
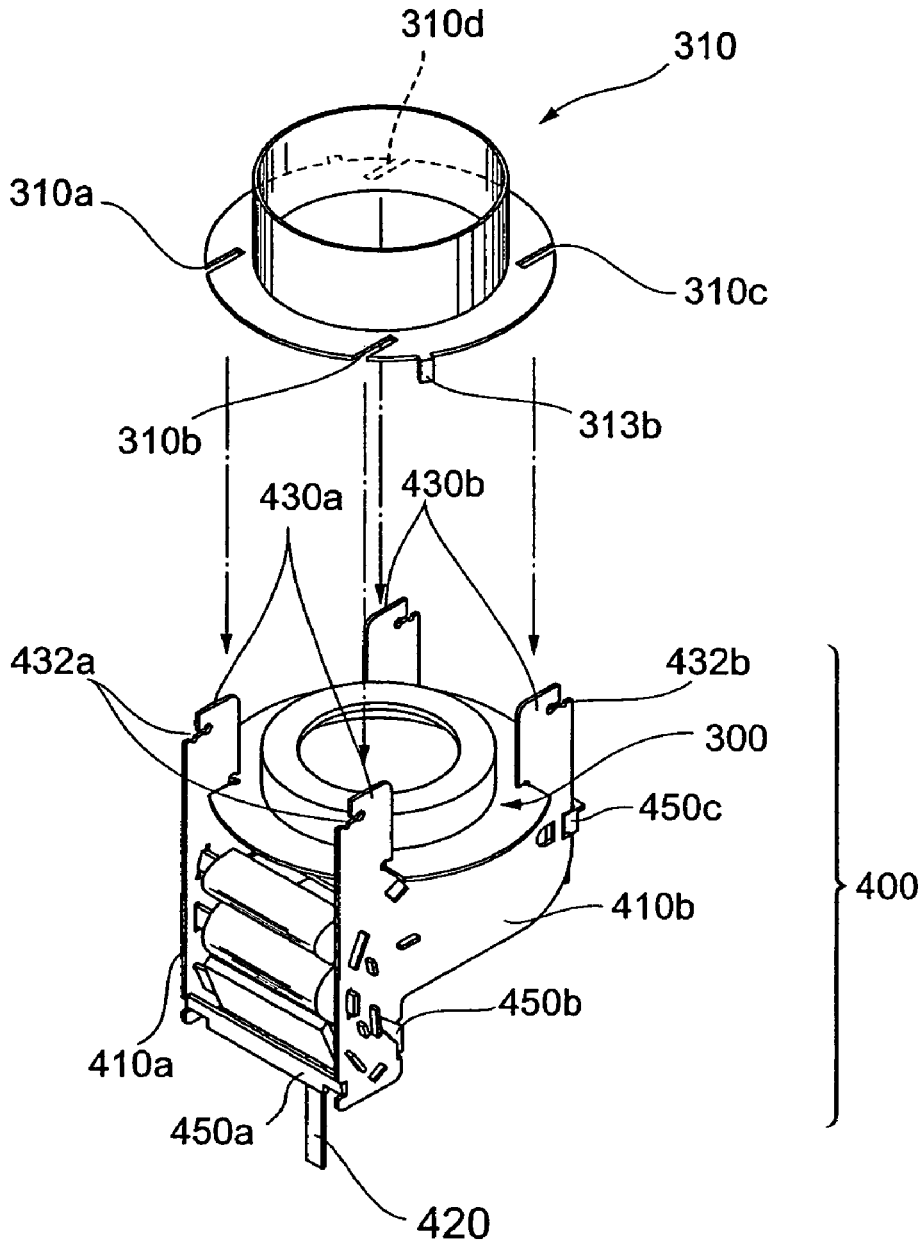
FIG. 7 is a view for explaining a mounting process of the accelerating electrode to the pair of insulating support members.

The lower electrode 320 and upper electrode 320 having the aforementioned structure, as shown in FIG. 7, are fixed in a welded state to the first and second insulating support members 410*a*, 410*b* arranged to oppose each other.

Figure 8:
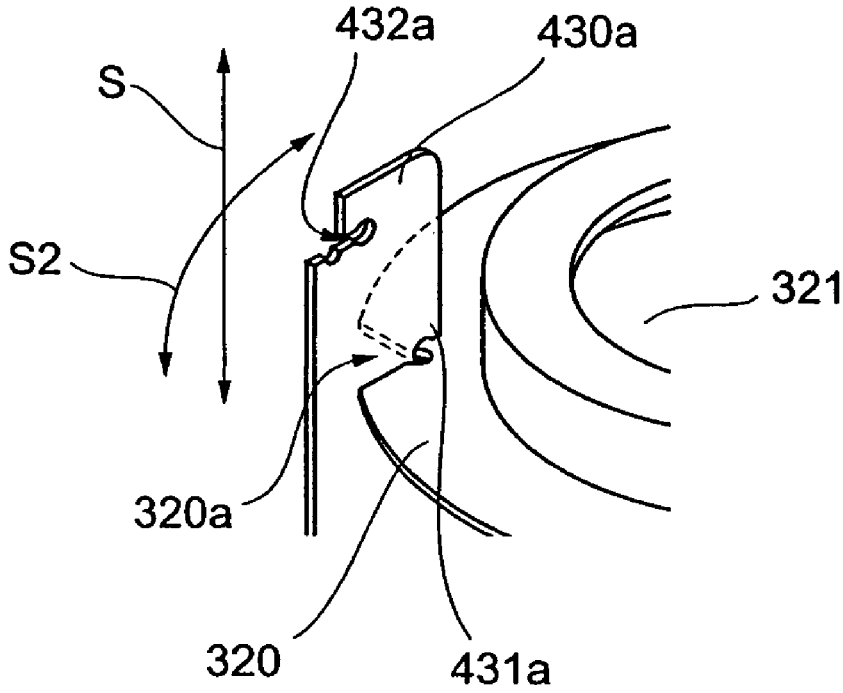
FIG. 8 is an enlarged view for explaining the mounting process of FIG. 7 in further detail.

First, the lower electrode 320 is grasped by the first and second insulating support members 410*a*, 410*b* with the first to seventh dynodes DY1-DY7, anode 420, and reflection-type dynode DY8. At this time, the lower electrode 320 is grasped by the first and second insulating support members 410*a*, 410*b* in a state that areas (parts corresponding to regions 321*a*-321*d* shown in FIG. 5) provided with the notched portions 320*a*-320*d* of the flange portion are fit in the slit grooves 431*a*, 431*b* formed at the protruding portions 430*a*, 430*b*, respectively. As a result, the lower electrode 320 is fixed to the first and second insulating support members 410*a*, 410*b* in a state that the flange portion thereof is surrounded by the protruding portions 430*a*, 430*b*. Furthermore, FIG. 8 is an enlarged view illustrating a setting situation of the notched portion 320*a* of the lower electrode 320 in particular. Note that the lower electrode 320 is aligned to only the direction designated by the arrow S1 in FIG. 8 when it is grasped by the first and second insulating support members 410*a*, 410*b*; however, it is still slightly rotatable to the direction designated by the arrow S2.

Subsequently, the upper electrode 310, as shown in FIG. 7, is disposed on the lower electrode 320 in a state that the protruding portions 430*a*, 430*b* are pinched into the slit grooves 310*a*-310*d*. At this time, the upper electrode 310, which is different from the lower electrode 320, is movable to the direction represented by the arrow S1 in FIG. 8, but cannot be rotated to the direction represented by the arrow S2. For this reason, when the fixing areas 313*a*, 313*b* provided at the outer periphery of the flange portion of the upper electrode 310 are welded at the lower electrode 320, the upper electrode 310 and lower electrode 320 are unitedly fixed (aligned) to the first and second insulating support members 410*a*, 410*b*.

Figure 9:
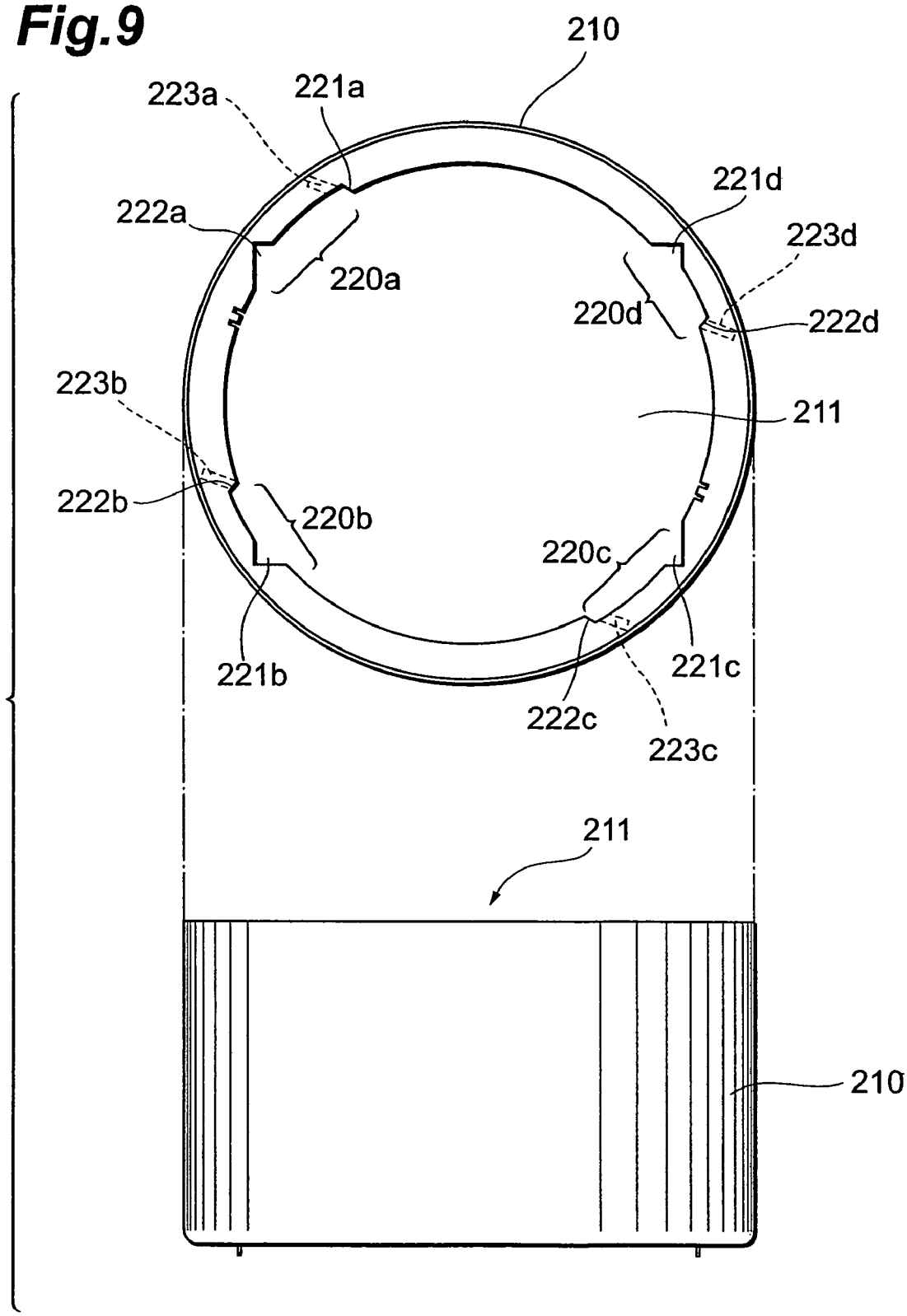
FIG. 9 is a plan view and a side view for explaining the structure of the focusing electrode.

Furthermore, FIG. 9 is a plan view and a side view for explaining the structure of the focusing electrode 200.

In particular, the focusing electrode 200 is constituted by the body unit 210 shown in FIG. 9 (substantially a main body of the focusing electrode; there are some cases that the body unit 210 herein may be simply called 'focusing electrode') and the reinforcing members 250*a*, 250*b* controlling the rotation of the body unit 210. The body unit 210, as shown in FIG. 9, has a flange portion that has a cylindrical shape, extends from one opening end of the body unit to the inside, and defines the through hole 211. At the flange portion, notched portions 220*a*-220*d* are formed to be grasped by slit grooves

432*a*, 432*b* provided at the protruding portions 430*a*, 430*b* of the first and second insulating support members 410*a*, 410*b*. Note that these notched portions 220*a*-220*d* is constituted by introducing portions 221*a*-221*d* for housing the protruding portions 430*a*, 430*b* via the through hole 211 in the focusing electrode 200, and fixing portions 222*a*-222*d* for limiting the rotation of the body unit 210 around the tube axis of the sealed container 110.

The body unit 210 having the aforementioned structure is fixed to the slit grooves 432*a*, 432*b* formed at the respective protruding portions 430*a*, 430*b* of the first and second insulating support members 410*a*, 410*b* in such a manner that the body unit 210 itself rotates around 4 the tube axis of the sealed container 110.

Figure 10:
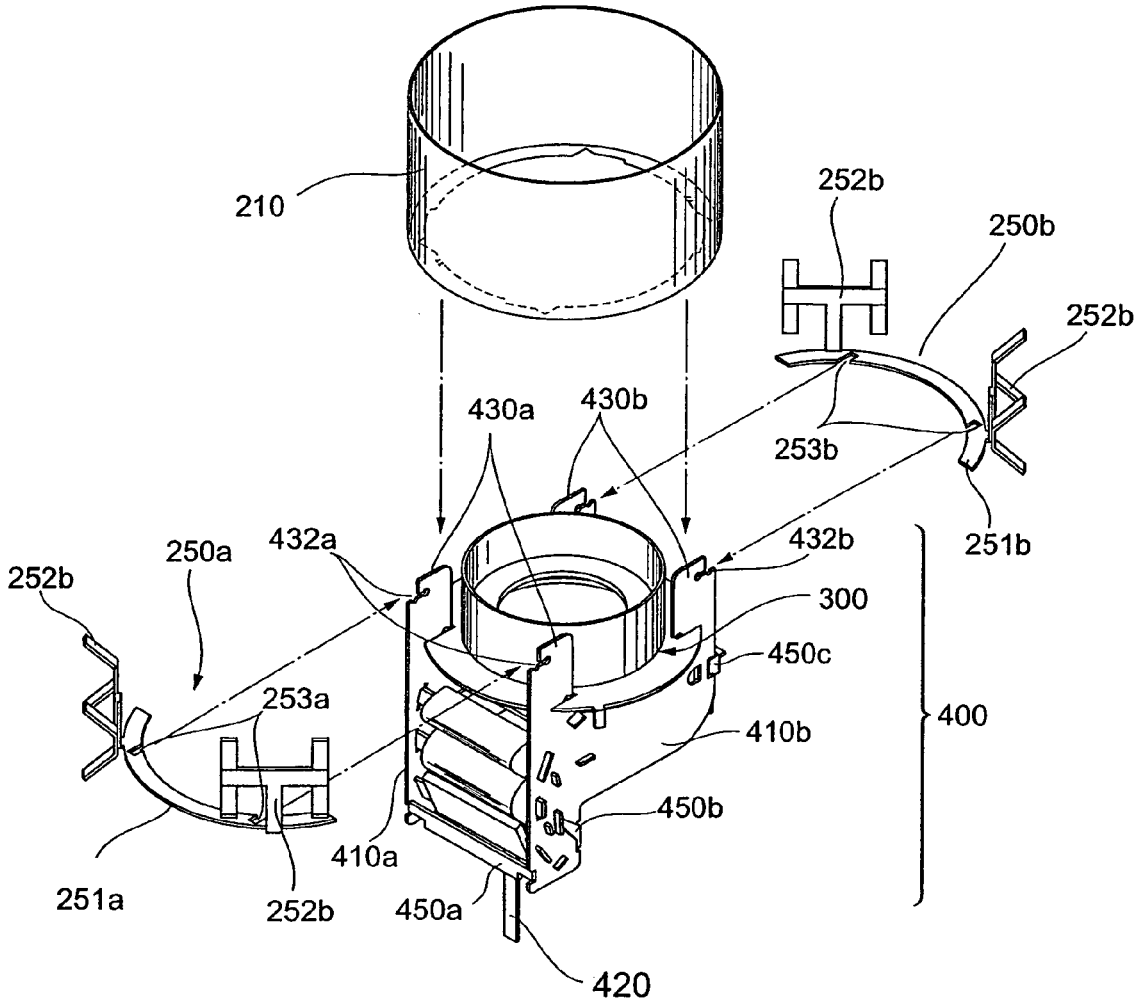
FIG. 10 is a view for explaining a mounting process of focusing electrode to the pair of insulating support members.

Specifically, as shown in FIG. 10, the protruding portions 430*a*, 430*b* of the first and second insulating support members 410*a*, 410*b* that grasp the first to seventh dynodes DY1-DY7, anode 420, reflection-type dynode DY8, and accelerating electrode 300 are inserted into the through hole 211 of the body unit 210. The situation of this case is shown in an enlarged view of FIG. 11.

Figure 11:
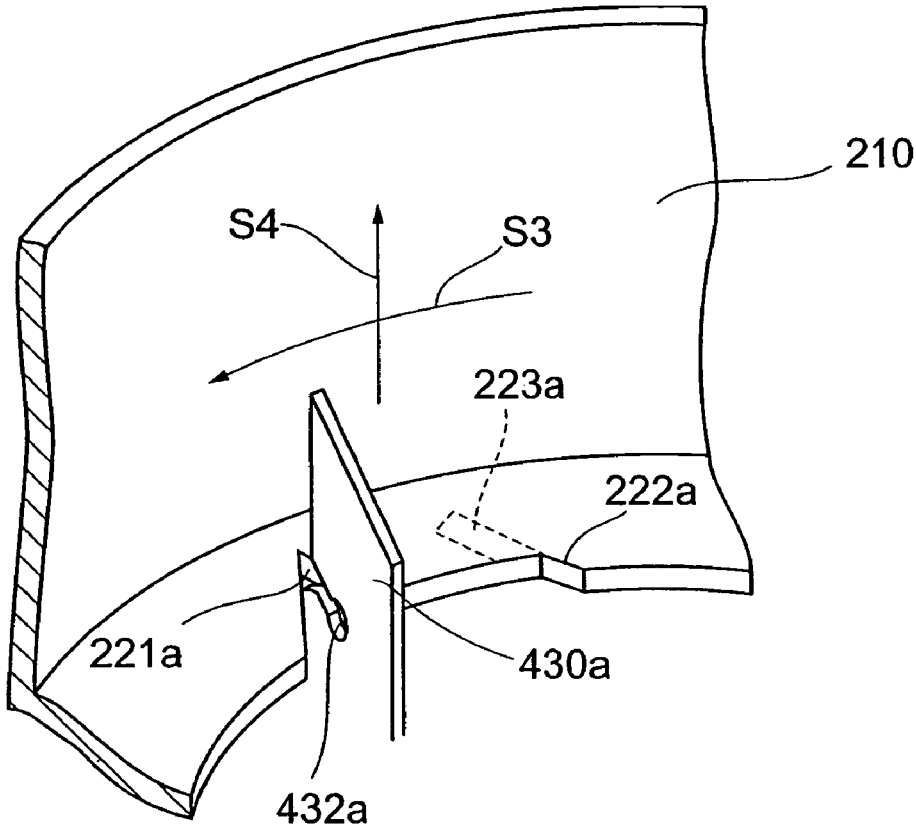
FIG. 11 is an enlarged view for explaining the mounting process of FIG. 10 in further detail.

In other words, the protruding portions 430*a*, 430*b* are inserted from the introducing portions 221*a*-221*d* in the notched portions 220*a*-220*d* along the direction designated by the arrow S4 in FIG. 11. Thereafter, the body unit 210 rotates in the direction designated by the arrow S3 shown in FIG. 11, so that the slit grooves 432*a*, 432*b* of the protruding portions 430*a*, 430*b* can abut with the fixing sections 222*a*-222*d*. At this time, the slit grooves 432*a*, 432*b* of the protruding portions 430*a*, 430*b* may grasp the areas designated by 223*a*-223*d* of the flange portion of the body unit 210. In this way, the body unit 210 itself is fixed to the direction designated by the arrow S4 in FIG. 11. However, since the body unit 210 is not fixed to the direction designated by the arrow S3, the reinforcing members 250*a*, 250*b* are fixed by welding to restrict the rotation along the direction designated by the arrow S3 of the body unit 210.

The reinforcing member 250*a* is constituted by a main body plate 251*a* abutted with the flange portion of the body unit 210 and a spring portion 252*a* abutted with the side of the body unit 210. Also, the main body plate 251*a* is provided with a slit groove 253*a* for pinching the protruding portions 430*a* of the first and second insulating members 410*a*, 410*b* arranged to oppose each other. In similar, the reinforcing member 250*b* is constituted by a main body plate 251*b* abutted with the flange portion of the body unit 210 and a spring portion 252*b* abutted with the side of the body unit 210. Also, the main body plate 251*b* is provided with a slit groove 253*b* for pinching the protruding portion 430*b* of the first and second insulating members 410*a*, 410*b* arranged to oppose each other.

Figure 12:
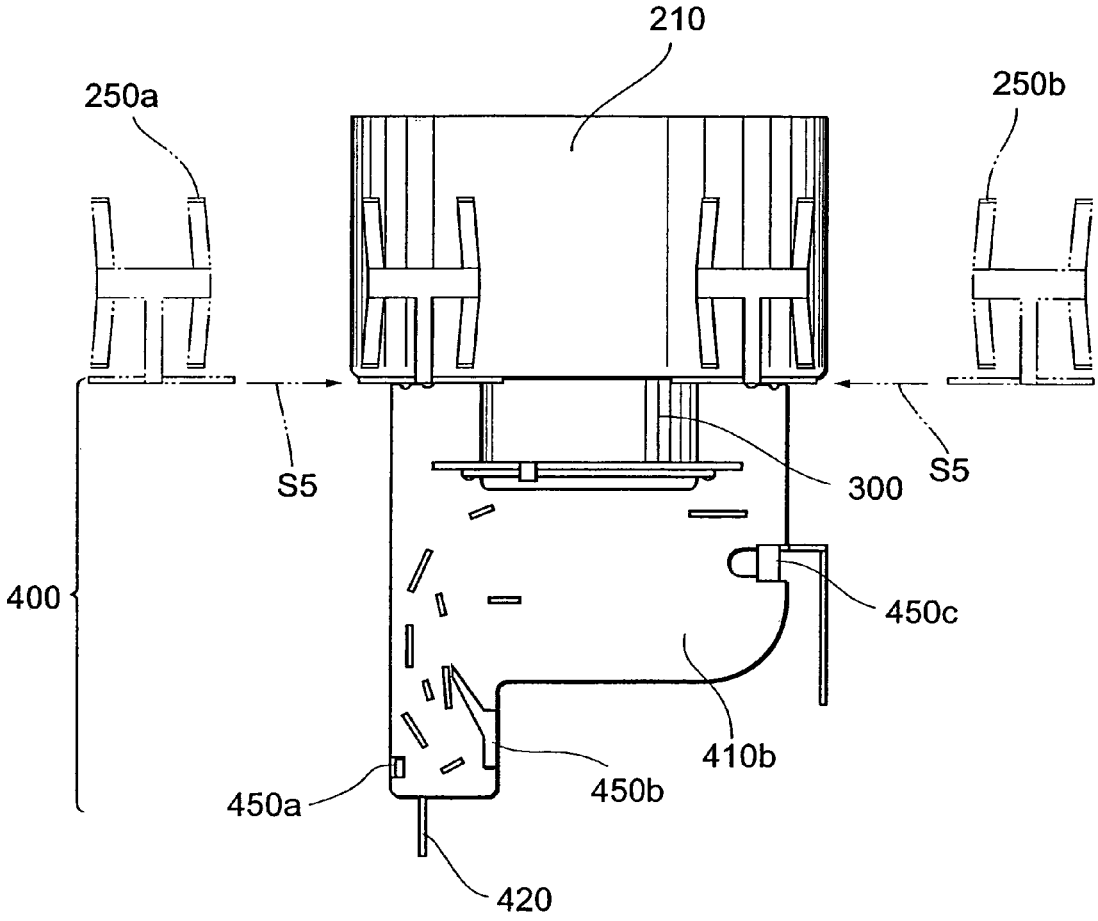
FIG. 12 is a side view illustrating an electron-multiplying unit applied to the photomultiplier according to the first embodiment.

These reinforcing members 250*a*, 250*b* are inserted from the direction designated by the arrow S5 in FIG. 12 (the slit grooves 253*a*, 253*b* pinching the protruding portions 430*a*, 430*b*). As described above, the body unit 210 is fixed in the direction designated by the arrow S4 in FIG. 11; however, it is not fixed in the direction designated by the arrow S3. On the other hand, the reinforcing members 250*a*, 250*b* pinch the protruding portions 430*a*, 430*b* by the slit grooves 253*a*, 253*b* to thereby be fixed in the direction designated by the arrow S3, while they are fixed in the direction designated by the arrow S4. When the above body unit 210 and each of the reinforcing members 250*a*, 250*b* are fixed by welding, the focusing electrode 200 is unitedly fixed (aligned) to the first and second insulating members 410*a*, 410*b*.

The electron-multiplying unit to be housed in the sealed container 110 through the above assembly processes.

Figure 13B:
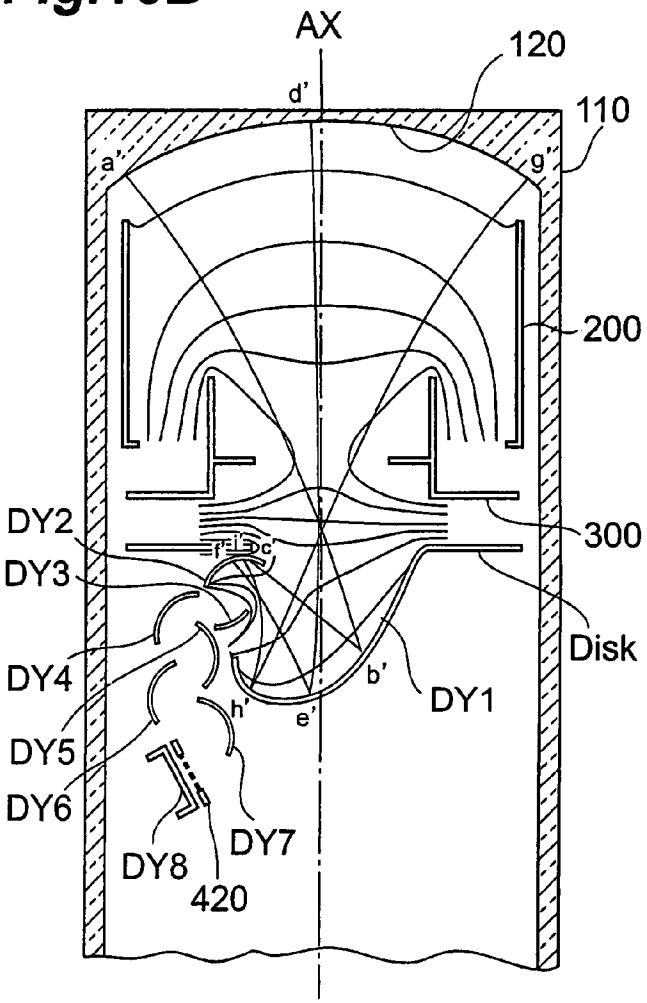
FIG. 13B is a view for explaining the operation of a photomultiplier provided as a comparative example.
Figure 13A:
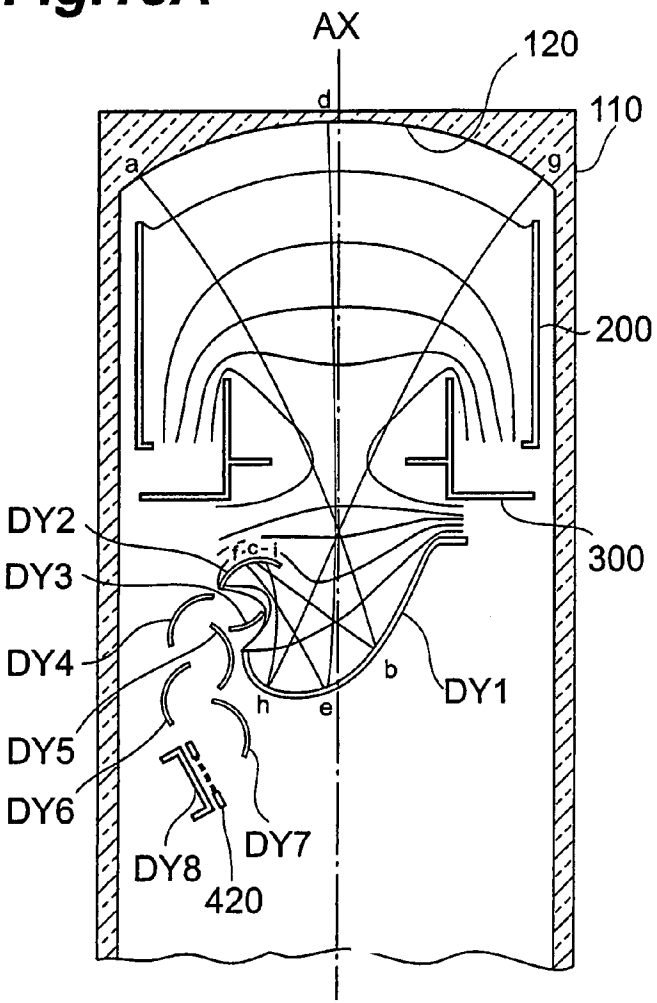
FIG. 13A is a view for explaining the operation of the photomultiplier according to the first embodiment.

Effects of the photomultiplier according to the present invention will next be described with reference to FIG. 13A and FIG. 13B. Here, FIG. 13A is a view for explaining the operation of the photomultiplier according to the first embodiment obtained through the aforementioned assembly processes; FIG. 13B is a view for explaining the operation of a conventional photomultiplier provided as a comparative example.

In the photomultiplier according to the first embodiment, as shown in FIG. 13A, photoelectrons emitted from the positions a, d and g is incident upon a second dynode DY2 along any one of orbits of a-b-c, d-e-f and g-h-i. At this time, because the focusing electrode 200 and accelerating electrode 300 are disposed between the cathode 120 and first dynode DY1, transit times of the photoelectrons along orbits of a-b, d-e and g-h are almost the same.

In addition, in the photomultiplier according to the first embodiment, because conductive members are not disposed between the accelerating electrode 300 and first dynode DY1, a high electric field (caused by a high potential of the accelerating electrode) enters on the side of the position b at the first dynode DY1. Therefore, an electrostatic lens formed between the first dynode DY1 and second dynode DY2 are formed by potentials of the accelerating electrode 300, second dynode DY2, and third dynode DY3. Thus, since secondary electrons also emitted from the position b on the emission surface of the secondary electrons at the first dynode DY1 are incident on the second dynode DY2 while pulled by a high potential, the transit time of the secondary electrons tracing the orbit b-c is almost the same as that of the secondary electrons tracing the orbit h-i. That is, in the case of the photomultiplier according to the present invention, the transit time of electrons from the cathode 120 to the dynode DY2 via the first dynode DY1 is almost the same in any one of the orbits a-b-c, d-e-f, and g-h-I, thereby reducing CTTD and obtaining excellent TTS.

On the other hand, also in the photomultiplier according to the comparative example, since the focusing electrode 200 and accelerating electrode 300 are arranged between the cathode 120 and first dynode DY1, the transit time of photoelectrons in each of the orbits a'-b', d'-e' and g'-h' is almost the same. However, in the photomultiplier according to the comparative example, as shown in FIG. 13B, since a disk (having the same potential as that of the first dynode DY1, and further having the potential higher than that of the focusing electrode 200 and lower than that of the accelerating electrode 300) is blocking the electric field caused by the accelerating electrode 300, the electrostatic lens formed between the first dynode DY1 and second dynode DY2 is formed by only the potentials of the second dynode DY2 and third dynode DY3. The secondary electrons emitted from the position h' closer to the third dynode DY3 on the emission surface of the secondary electrons are incident on the second dynode DY2 under the influence of a stronger electric field (while pulled by a higher potential). In contrast, the secondary electrons emitted from the position b' are incident on the second dynode DY2 under the influence of a weaker electric field (while pulled by a lower potential). As a result, the transit time of the secondary electrons tracing the orbit b'-c' may be longer than that of the secondary electrons tracing the orbit h'-i'. That is, in the case of the photomultiplier according to the comparative example, the transit time of electrons reaching from the cathode 120 to the second dynode DY2 via the first dynode DY1 is longer in the order of the orbits g'-h'-i', d'-e'-f', and a'-b'-c', thereby increasing CTTD, and deteriorating TTS.

The photomultiplier according to the present invention is not limited to the constructions of the aforementioned first embodiment, and permits a variety of modifications.

Figure 14B:
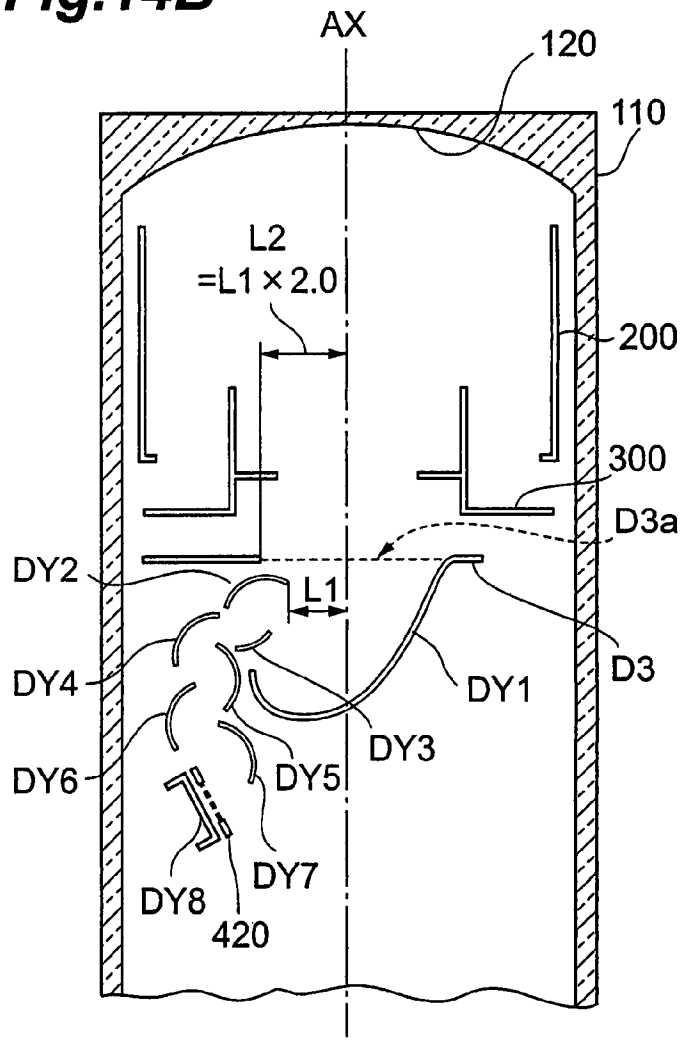
FIG. 14B is a view illustrating a sectional structure of the application thereof.
Figure 14A:
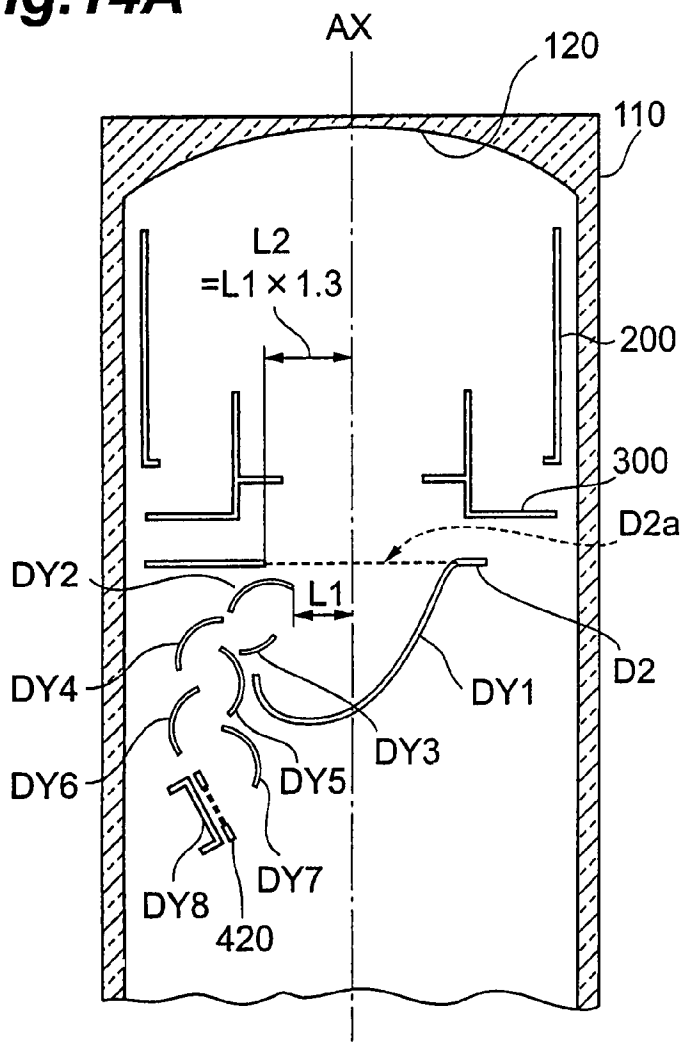
FIG. 14A is a view illustrating a sectional structure of a second embodiment of the photomultiplier according to the present invention.

For example, FIG. 14A is a view illustrating a sectional structure of a second embodiment of the photomultiplier according to the present invention; FIG. 14B is a view illustrating a sectional structure of the application thereof.

In accordance with to the photomultiplier according to the second embodiment illustrated in FIG. 14A, similarly to a conventional photomultiplier, the first dynode DY1 contained in the dynode unit is supported directly between the accelerating electrode 300 and dynode unit, and a metal disk D2 set to the same potential as that of the first dynode DY1 is arranged therebetween. However, in the photomultiplier according to the second embodiment, the metal disk D2 has a through hole D2*a* to be passed through by the photoelectrons from the cathode 120; the shortest distance from the tube axis of the sealed container 110 to the edge of the through hole D2*a* is set to 1.3 times or more the shortest distance from the tube axis of the sealed container 110 to the end portion of the second dynode DY2. The aforementioned required characteristics can be satisfied by such a construction as well.

In addition, FIG. 14B shows an applied example of the photomultiplier according to the second embodiment shown in FIG. 14A. In this applied example, the shortest distance from the tube axis of the sealed container to the edge of the through hole D3*a* of the metal disk D3 may be two or more times the shortest distance from the tube axis of the sealed container to the end portion of the second dynode DY2 contained in the dynode unit. Also, in this case, it is possible to satisfy the aforementioned required characteristics.

Figure 15:
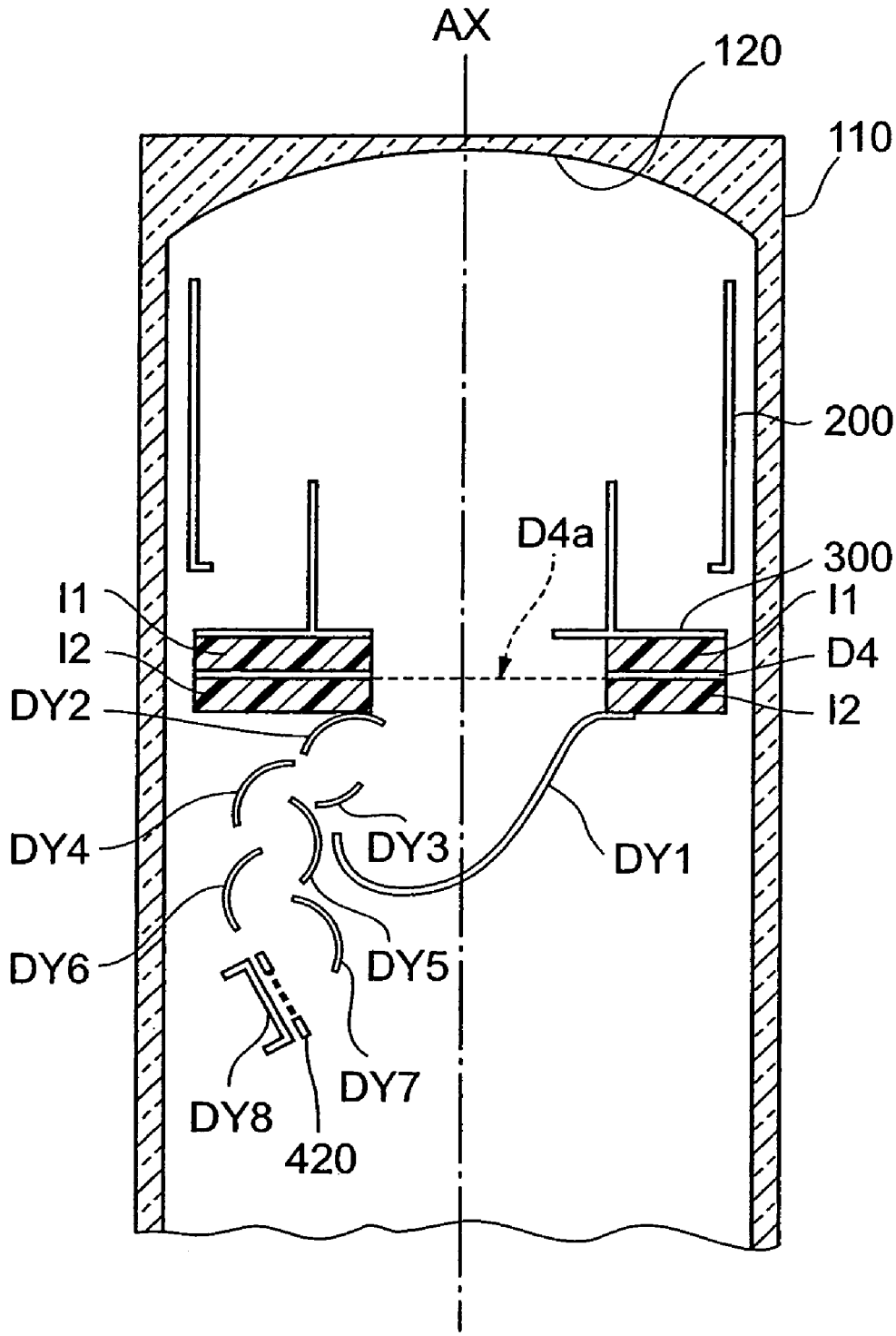
FIG. 15 is a view illustrating a cross-sectional structure of the photomultiplier of a third embodiment according to the present invention.

Further, FIG. 15 is a view illustrating a sectional structure of a third embodiment of the photomultiplier according to the present invention. Also, the photomultiplier according to the third embodiment of the present invention has a metal disk D4 with an opening D4*a* arranged between the accelerating electrode 300 and first dynode DY1 and supporting directly the first dynode DY1. However, the metal disk D4 is arranged in a state that the metal disk D4 is insulated from both of the accelerating electrode 300 and first dynode DY1 through insulators I1, I2 (ceramic spacer), and is set to a potential that is lower than that of the accelerating electrode 300 and higher potential than that of the first dynode DY1. With this construction, it is possible to satisfy the aforementioned required characteristics as well. In addition, the insulation of the metal disk D4 can be achieved by simply providing a gap of a predetermined width between the accelerating electrode 300 and the metal disk D4, and further providing a gap of a predetermined width between the metal disk D4 and the first dynode DY1.

It should be noted that, as in the aforementioned second and third embodiments, when there is a construction such that the metal disks D2-D4 are separately arranged between the accelerating electrode 300 and first dynode DY1, a fixture structure of the accelerated electrode may be adopted.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A photomultiplier comprising:

a sealed container of which the inside is kept in a vacuum state;

a photocathode, placed in said sealed container, emitting photoelectrons to the inside of said sealed container in response to light having a predetermined wavelength;

a dynode unit placed in said sealed container and including a plurality of stages of dynodes emitting secondary electrons in response to the photoelectrons reached from said photocathode to cascade-multiply sequentially the secondary electrons, said plurality of stages of dynodes being constituted by at least a first-stage dynode which the photoelectrons from said photocathode initially reach and a second-stage dynode receiving the secondary electrons outputted from said first-stage dynode in response to the reached photoelectrons;

an anode, placed in said sealed container, taking out the secondary electrons cascade-multiplied by said dynode unit as a signal;

a pair of insulating support members holding unitedly said dynode unit and said anode in a state grasping said dynode unit and said anode;

a focusing electrode arranged between said photocathode and said dynode unit, and having a through hole through which the photoelectrons from said photocathode pass, said focusing electrode correcting an orbit of each photoelectron emitted from said photocathode; and an accelerating electrode, for accelerating the photoelectrons reached from said photocathode via said focusing electrode, arranged between said focusing electrode and said dynode unit, and having a through hole through which the photoelectrons reached from said photocathode via said focusing electrode pass, said accelerating electrode being set to a potential higher than that of said first-stage dynode, wherein each of said pair of insulating support members has a portion directly gripping said accelerating electrode together with said dynode unit in a state that at least said first-stage dynode and said second-stage dynode included in said dynode unit are directly opposite to said accelerating electrode not connected through a conductive member, whereby a position variation of said accelerating electrode with respect to said dynode unit is restricted in both of a first direction extending from said photocathode to said dynode unit and a second direction orthogonal to the first direction.

* * * * *